US009748706B2

(12) United States Patent
Lv et al.

(10) Patent No.: US 9,748,706 B2
(45) Date of Patent: Aug. 29, 2017

(54) ELECTRICAL CONNECTOR HAVING IMPROVED DETECTIVE MEMBER

(71) Applicant: FOXCONN INTERCONNECT TECHNOLOGY LIMITED, Grand Cayman (KY)

(72) Inventors: Wen-Feng Lv, Kunshan (CN); Yi-Wen Cheng, Kunshan (CN); Dou-Feng Wu, Kunshan (CN); Xiao-Li Li, Kunshan (CN); Chien-Hsun Huang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/228,208

(22) Filed: Aug. 4, 2016

(65) Prior Publication Data

US 2017/0040752 A1 Feb. 9, 2017

(30) Foreign Application Priority Data

Aug. 4, 2015 (CN) ..... 2015 1 0469637
Aug. 4, 2015 (CN) ..... 2015 1 0469813

(51) Int. Cl.

| | |
|---|---|
| ***H01R 3/00*** | (2006.01) |
| ***H01R 13/66*** | (2006.01) |
| ***H01R 13/717*** | (2006.01) |
| *H01R 24/62* | (2011.01) |
| *H01R 13/70* | (2006.01) |
| *H01R 107/00* | (2006.01) |

(52) U.S. Cl.

CPC ..... *H01R 13/6683* (2013.01); *H01R 13/6658* (2013.01); *H01R 13/7175* (2013.01); *H01H 2239/006* (2013.01); *H01R 13/70* (2013.01); *H01R 24/62* (2013.01); *H01R 2107/00* (2013.01)

(58) Field of Classification Search

CPC ..... H01R 13/717; H01R 13/7175
USPC ..... 439/490
See application file for complete search history.

(56) References Cited

U.S. PATENT DOCUMENTS 7,393,237 B2 * 7/2008 Kuo ..... H01R 13/6691 362/249.01
7,628,619 B2 * 12/2009 Chuang ..... H01R 13/6658 439/620.08
7,744,231 B2 6/2010 Hutchinson et al.
(Continued)

FOREIGN PATENT DOCUMENTS

CN 203277853 11/2013
CN 203660206 6/2014
(Continued)

*Primary Examiner* — Phuong Dinh
(74) *Attorney, Agent, or Firm* — Wei Te Chung; Ming Chieh Chang

(57) ABSTRACT

An electrical connector connecting with a cable electrically includes a mating member, a printed circuit board connected with the mating member and the cable electrically, a light source positioned on the printed circuit board, a detector controlling the light source, a light transmissive member permitting transmission of a light emitted from the light source therethrough, a metal shell enclosing the light transmissive member and the printed circuit board, and a detective member connecting the detector and the metal shell electrically.

7 Claims, 16 Drawing Sheets

(56) References Cited

U.S. PATENT DOCUMENTS

| | | | | |
|---|---|---|---|---|
| 7,758,373 | B2 * | 7/2010 | Zhou | H01R 13/562 439/455 |
| 7,976,336 | B2 * | 7/2011 | Yang | H01R 13/6658 439/490 |
| 8,124,496 | B2 * | 2/2012 | Su | H01R 13/7175 438/449 |
| 8,608,520 | B2 * | 12/2013 | Yuan | H01R 12/53 439/886 |
| 8,740,640 | B2 | 6/2014 | Hardy | |
| 9,160,118 | B2 * | 10/2015 | Tuchrelo | H01R 13/7175 |
| 9,461,417 | B2 * | 10/2016 | Zhang | H01R 13/7175 |
| 2010/0309657 | A1 * | 12/2010 | Purdy | F21L 4/005 362/200 |
| 2013/0034990 | A1 * | 2/2013 | Warren | H01R 13/7175 439/490 |
| 2013/0065444 | A1 | 3/2013 | Bushnell | |
| 2013/0308304 | A1 * | 11/2013 | Tuchrelo | H01R 13/7175 362/157 |
| 2017/0047695 | A1 * | 2/2017 | Ma | H01R 13/717 |

FOREIGN PATENT DOCUMENTS

| | | |
|---|---|---|
| CN | 204088797 | 1/2015 |
| TW | M500383 | 5/2015 |

* cited by examiner

ELECTRICAL CONNECTOR HAVING IMPROVED DETECTIVE MEMBER

BACKGROUND OF THE INVENTION

1. Field of the Invention

The present invention relates generally to an electrically connector, and more particularly to an electrical connector having a light source and an improved detective member.

2. Description of Related Arts

U.S. Patent Application Publication No. 2013/0065444, published on Mar. 14, 2013, discloses a charging connection device comprising: a device connector configured to be coupled to a rechargeable electronic device; a circuit board coupled to the connector and including charging circuitry and an associated light source thereon; a housing enclosing the circuit board and including a first end comprising a lens, the connector extending from the first end; a touch-type switch carried by the housing, coupled to the circuit board, and configured to activate the light source; and a power source connector coupled to the circuit board and associated with a second end of the housing. The touch-type switch, such as touch plates on opposite sides of the housing, may be a resistance touch switch which needs two electrodes to be in physical contact with something electrically conductive (for example, finger(s) of a user) to operate. A capacitance touch switch or a touch chip-type switch may also be used.

U.S. Pat. No. 8,740,640, issued on Jun. 3, 2014, discloses an electrical connector including an LED and an electrical circuitry (e.g., implemented by a variable capacitance switch) to automatically energize the LED by a user's mere touching of an overmold thereof at its flat or bottom side without otherwise manually operating a control switch. A constant voltage is derived from power source and is applied across a variable and touch-sensitive capacitor and resistors to ground. In operation, before a user touches the flat or bottom portion of the overmold, capacitance is at a quiescent or fixed or default capacitance value; however, when a user touches the bottom or flat side of the overmold, the capacitor suddenly changes its capacitance value, and this causes the LED to be energized and emit light.

SUMMARY OF THE INVENTION

An object of the present invention is to provide an electrical connector having an improved detective member.

To achieve the above-mentioned object, an electrical connector connecting with a cable electrically includes a mating member, a printed circuit board connected with the mating member and the cable electrically, a light source positioned on the printed circuit board, a detector controlling the light source to turn on or to turn off, a light transmissive member permitting transmission of a light emitted from the light source therethrough, a metal shell enclosing the light transmissive member and the printed circuit board, and a detective member connecting the detector and the metal shell electrically.

Other objects, advantages and novel features of the invention will become more apparent from the following detailed description when taken in conjunction with the accompanying drawings.

DETAILED DESCRIPTION OF THE PREFERRED EMBODIMENT

Figure 1:
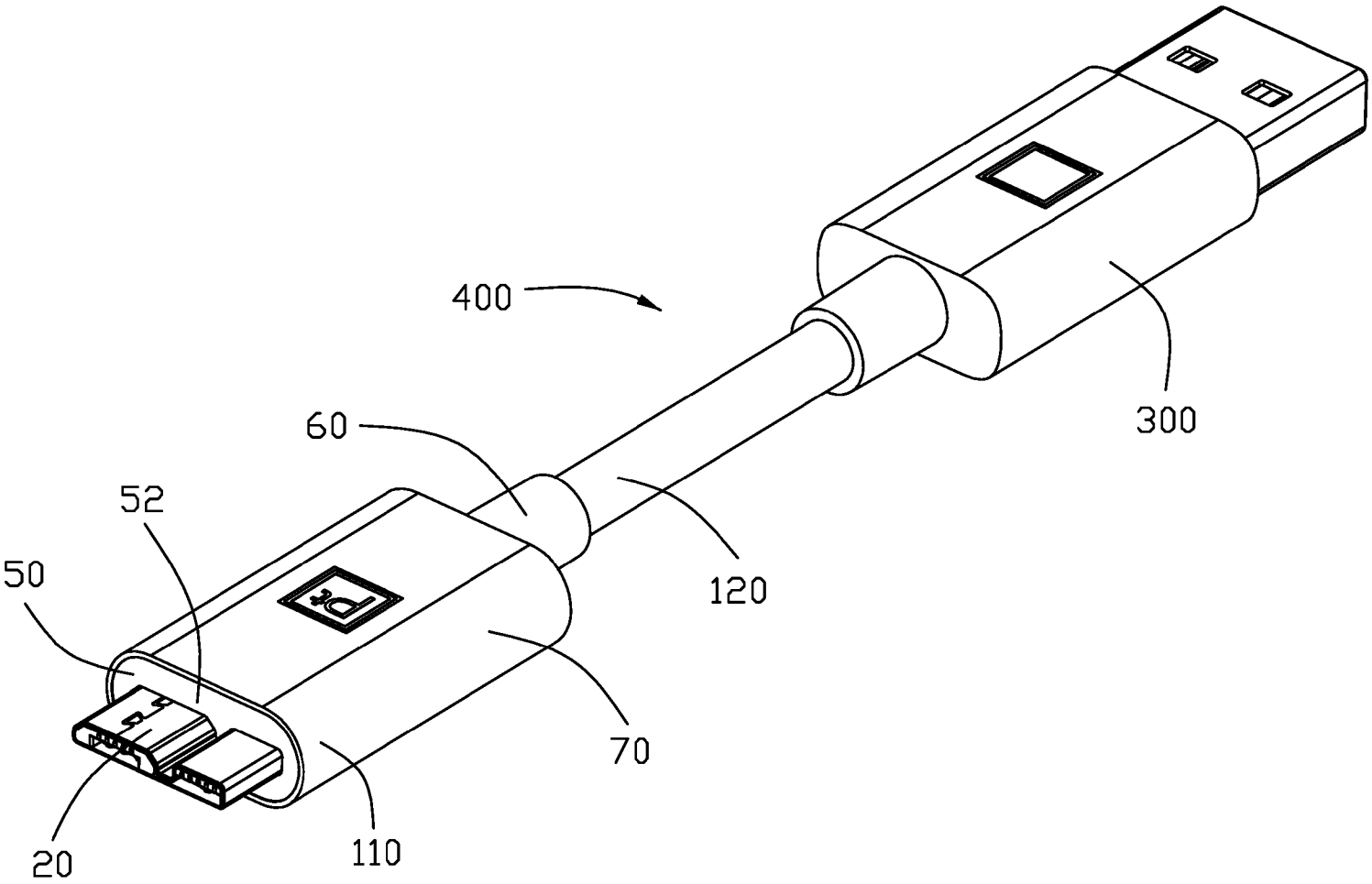
FIG. 1 is a perspective, assembled view of a cable connector assembly in accordance with a first embodiment of the present invention.
Figure 2:
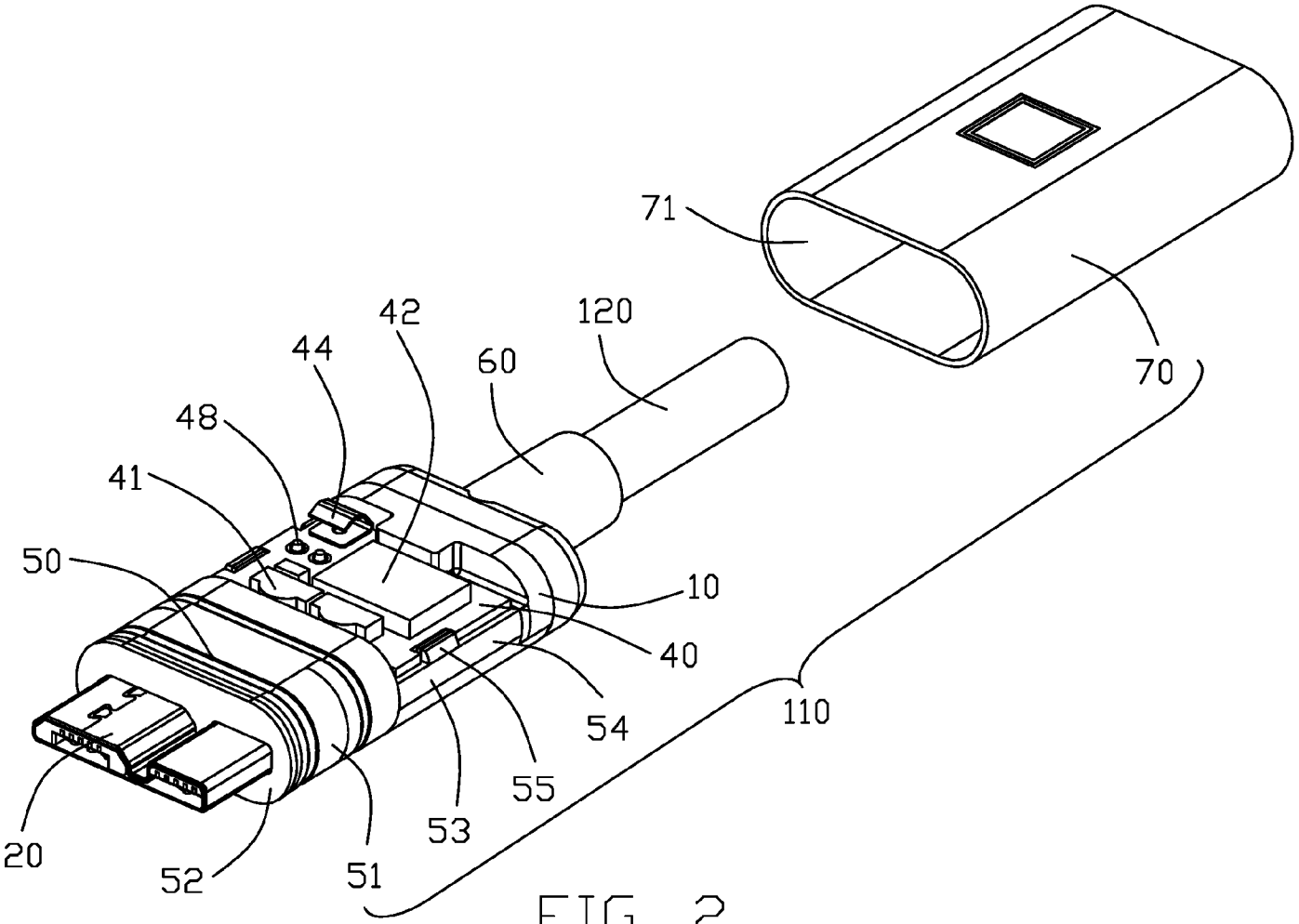
FIG. 2 is a perspective, partially exploded view of an electrical connector of the cable connector assembly shown in FIG. 1.
Figure 3:
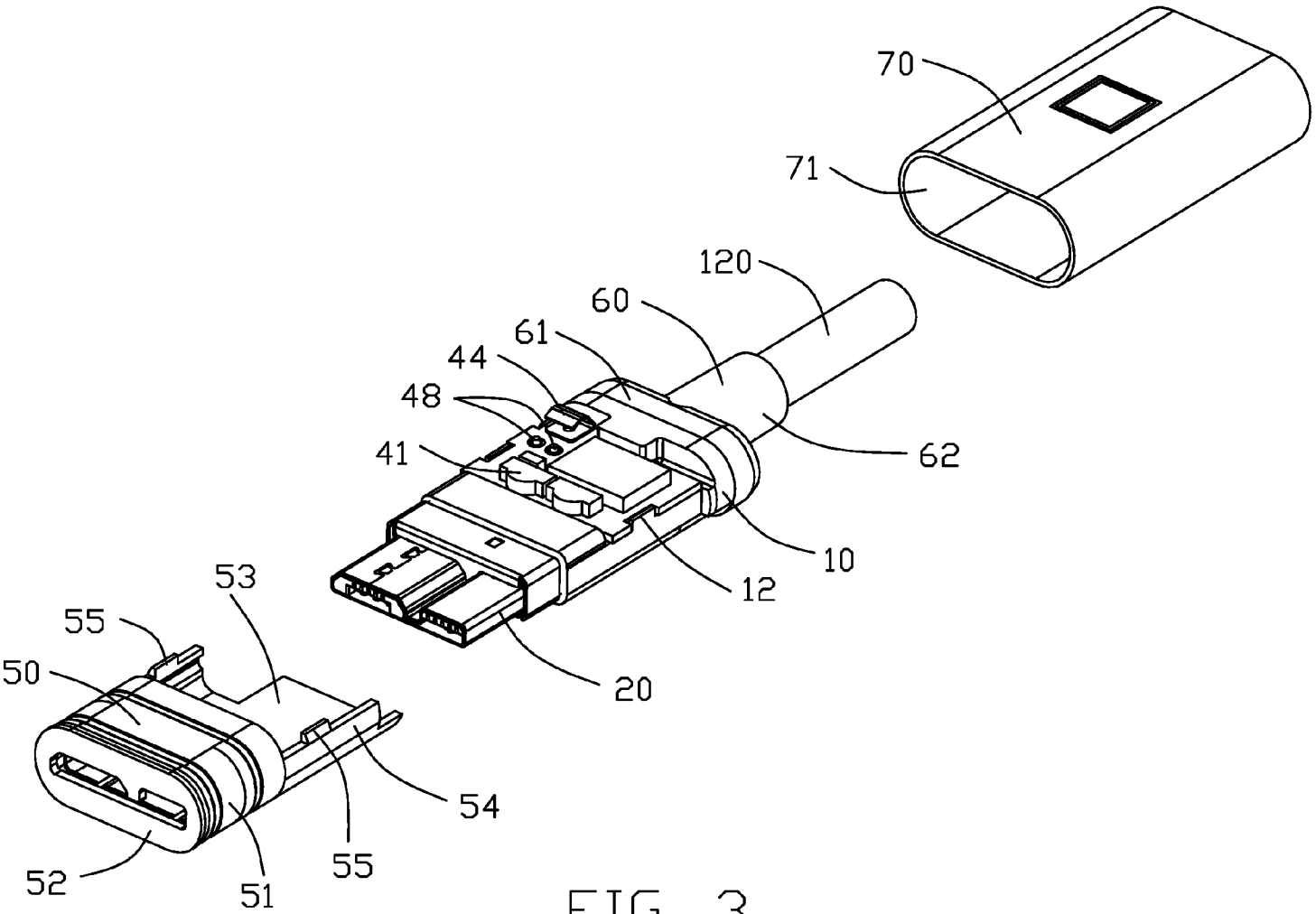
FIG. 3 is a further partially exploded view of the electrical connector shown in FIG. 2.
Figure 4:
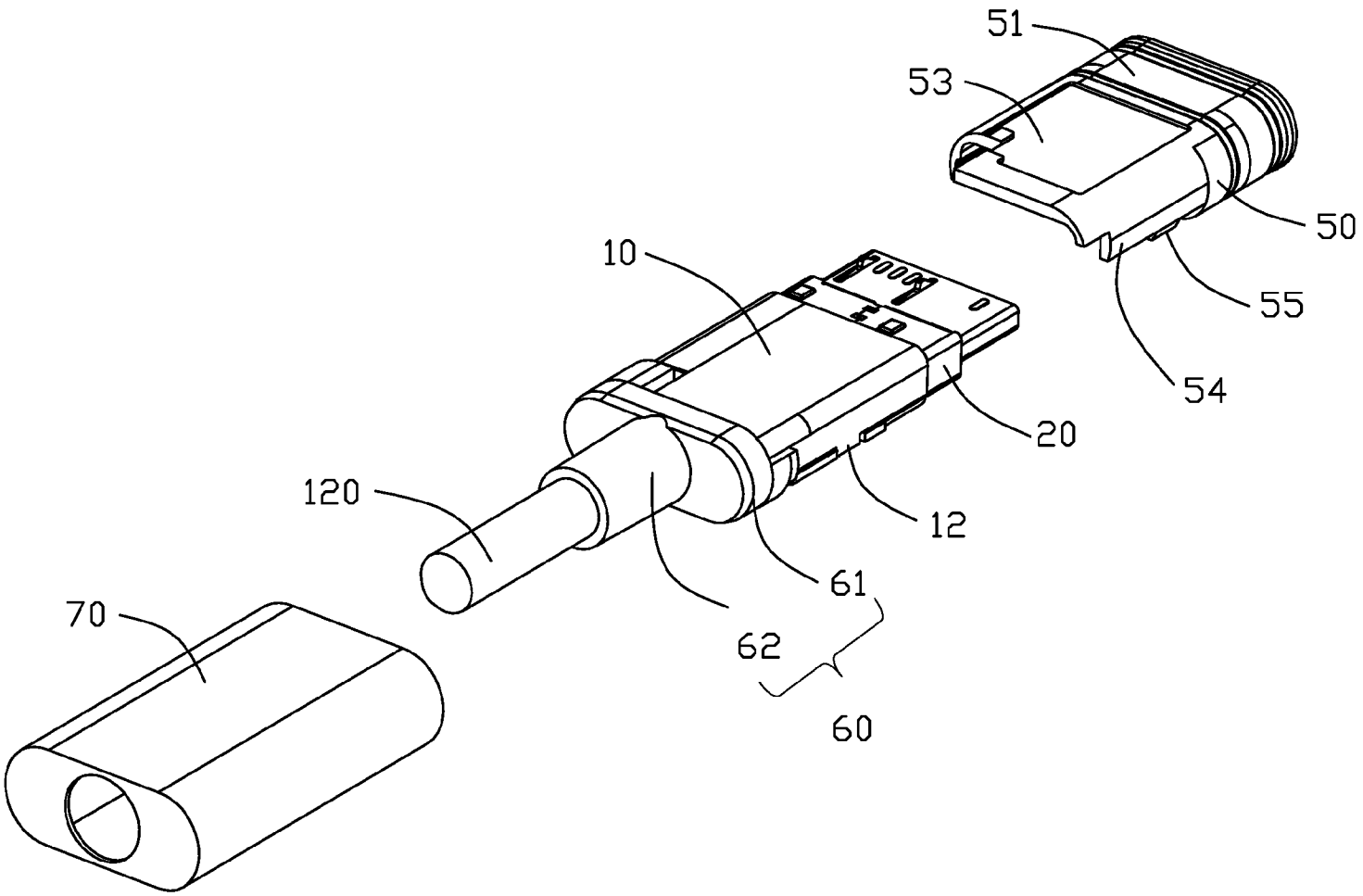
FIG. 4 is a view similar to FIG. 3, but viewed from another aspect.
Figure 5:
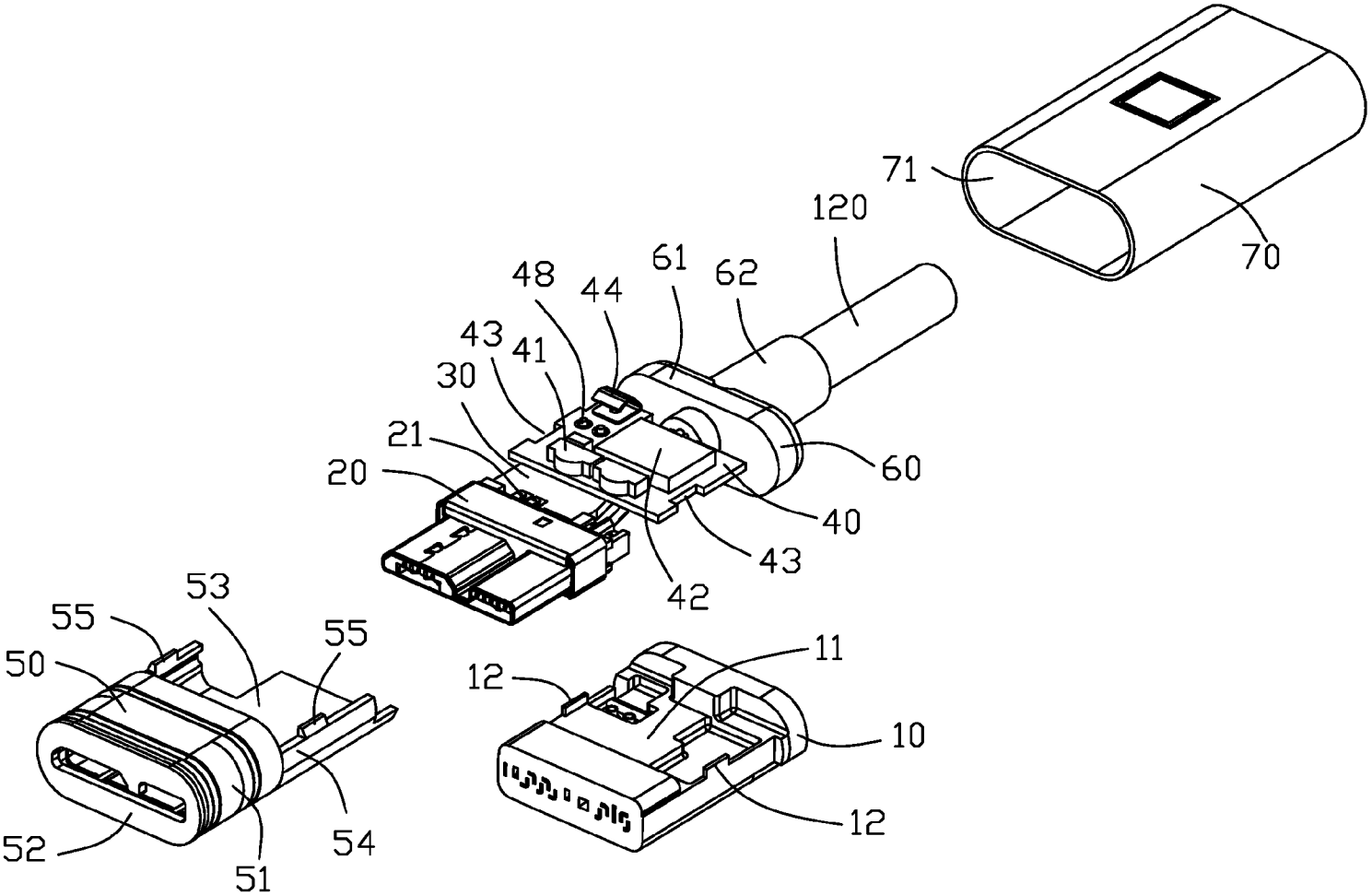
FIG. 5 is a further partially exploded view of the electrical connector shown in FIG. 3.
Figure 6:
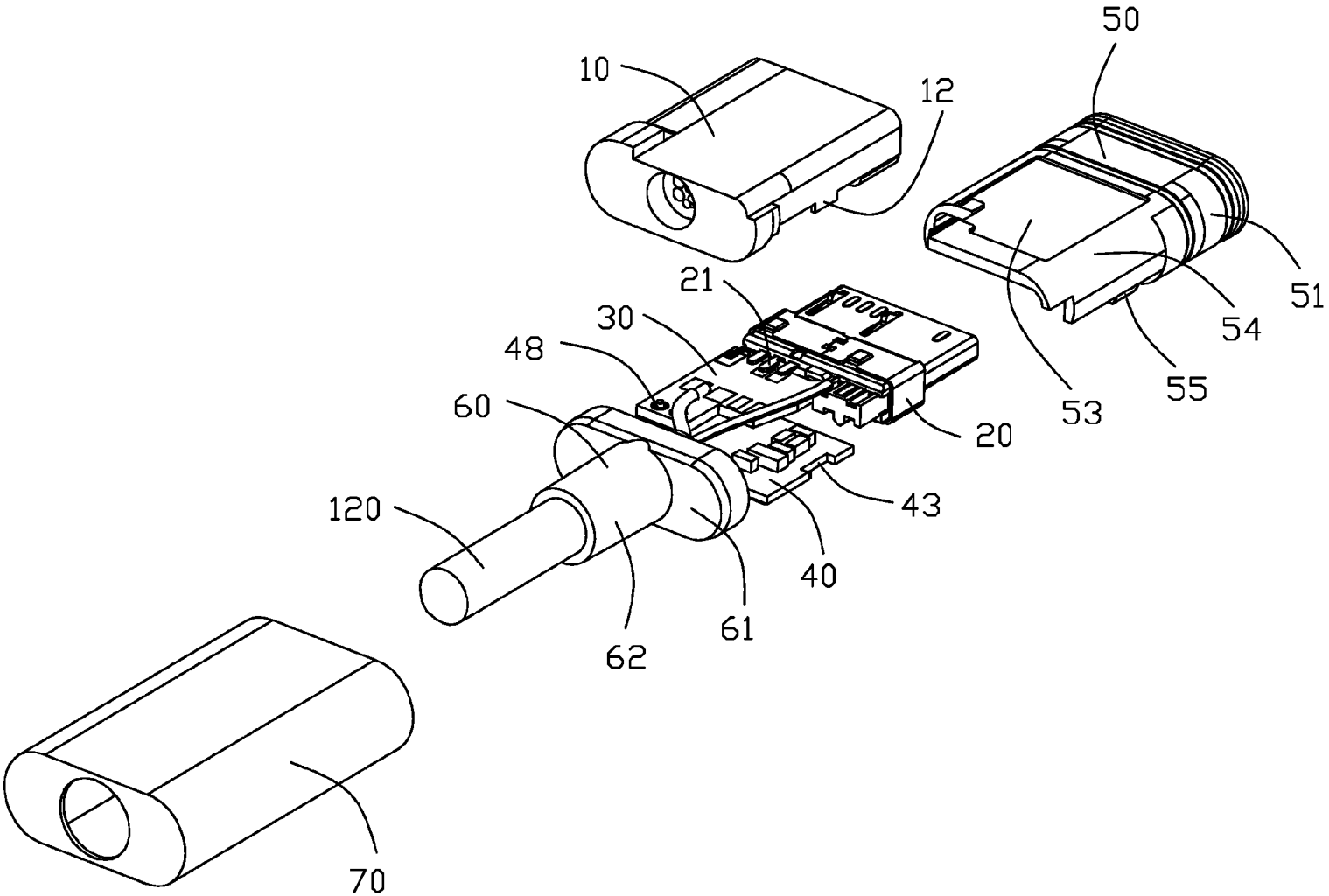
FIG. 6 is a view similar to FIG. 5, but viewed from another aspect.

Referring to FIG. 1, the cable connector assembly 400 in accordance with a first embodiment of the present invention comprises an electrical connector 110, a USB connector 300 and a cable 120 connecting the electrical connector 110 and the USB connector 300.

Referring to FIGS. 1-8, the electrical connector 110 comprises a mating member 20, a printed circuit board (not numbered), a light source 41 and a detector 42 assembled on the printed circuit board, a light transmissive member 50 permitting transmission of a light emitted from the light source 41 therethrough, a detective member 44 associated with the detector 42, an inner insulator 10 covering a rear end of the mating member and a front end of the cable 120, and a metal shell 70 defining a space 71 for enclosing the light transmissive member 50 and the inner insulator 10. In the embodiment of the present invention, the printed circuit board comprises a first printed circuit board 30 connected with the light transmissive member 50 and a second printed circuit board 40 on which the light source 41 is positioned. The first printed circuit board 30 and the second printed circuit board 40 are connected with each other electrically through a plurality of connecting contacts 48. The first printed circuit board 30 and the second printed circuit board 40 define a through hole 49 through which the connecting contacts 48 pass and are soldered to the corresponding printed circuit board respectively. The second printed circuit board 30 defines two troughs 43 located in two sides thereof. The light source 41 is a LED lamp.

Figure 7:
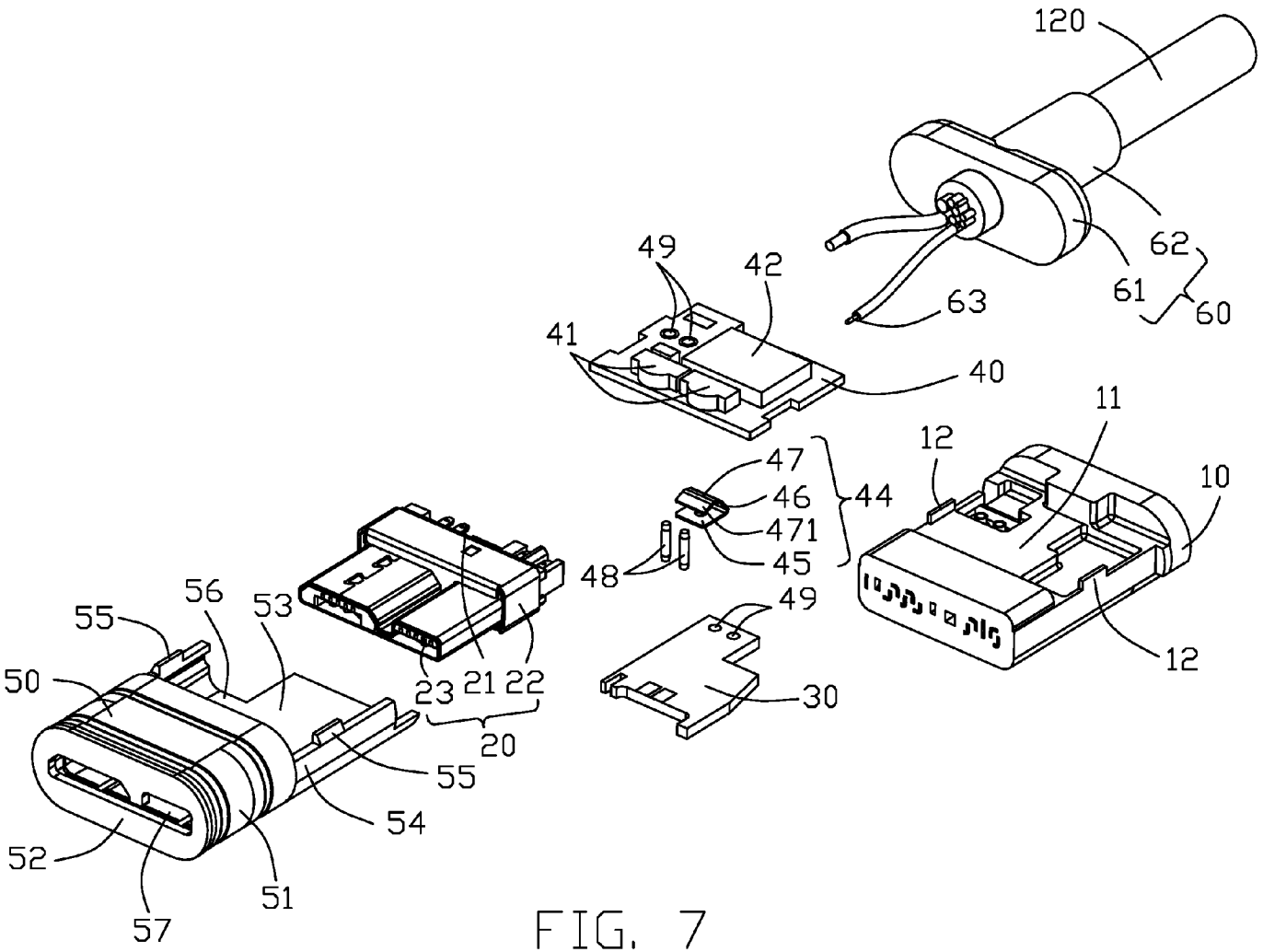
FIG. 7 is a perspective, exploded view of the electrical connector shown in FIG. 2.
Figure 8:
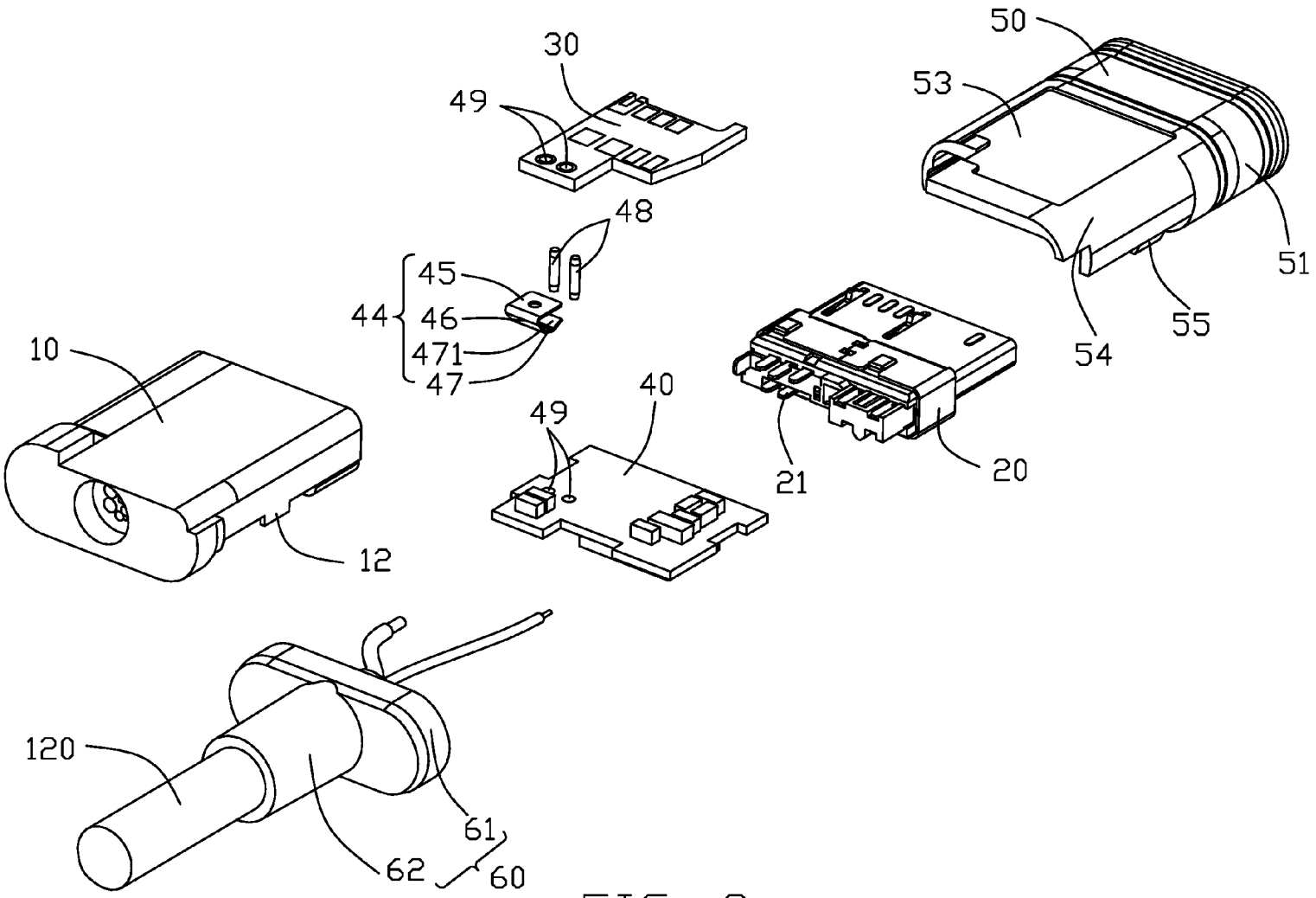
FIG. 8 is a similar to FIG. 7, but viewed from another aspect.

As shown in FIG. 7, the mating member 20 comprises an insulative housing 23, a plurality of contacts 21 and a shielding shell 22 enclosing the insulative housing 23. The inner insulator 10 comprises a receiving groove 22 sunken from a top surface of the inner insulator 10 and a pair of convex parts 12 extending upwardly from two sides of the inner insulator 10. The convex parts 12 are coordinated with the troughs 43.

The detective member 44 comprises a fixed section 45 fasten on the second printed circuit board 40, a mating section 47 resisting against the metal shell 70, a gradient section 471 extending downwardly from the mating section 47 and a connecting section 46 connecting the fixed section 45 and the mating section 47. In the embodiment of the present invention, the fixed section 45 is soldered to the second printed circuit board 40 and connected with the detector 42 electrically. The gradient section 471 is corresponded with the connecting section 46 for enhancing a strength of the mating section 47 and the connecting section 46 is elastic for resisting against the metal shell 70 closely. The mating section 47 is parallel to the fixed section 45. The gradient section 471 and the connecting section 46 are symmetrical approximately.

The light transmissive member 50 comprises a penetrable portion 51 through which the light penetrates, a positioning portion 53 extending rearwardly from the penetrable portion 51 and a receiving space 56 surrounded by the penetrable portion 51 and the positioning portion 53. The penetrable portion 51 comprises a penetrable section 52 located in a front end thereof and exposed out of a front end of the metal shell 70. The penetrable section 52 defines an opening 57 through which the mating member 20 passes. The opening 57 connects with the receiving space 56. The positioning portion 53 comprises a pair of side walls 54 and a pair of settled sections 55. In the embodiment of the present invention, the settled sections 55 extend upwardly from the side walls 54. The settled sections 55 are coordinated with the troughs 43 and the convex parts 12.

The cable 120 comprises a strain relief 60 and a plurality of wires 63. The strain relief 60 comprises a resisting section 61 and a holding section 62. The cable 120 is connected with the printed circuit board and the contacts 21 electrically.

In assembly, the light source 41 and the detector 42 are positioned to the second printed circuit board 40. The connecting contacts 48 are soldered to the first printed circuit board 30 and the second printed circuit board 40 so as to connect the first printed circuit board 30 and the second printed circuit board 40 electrically. The printed circuit board is located between the mating member 20 and the cable 120. The wires 63 are partially soldered to the contacts 21 of the mating member 20 and partially soldered to the printed circuit board. The fixed section 45 of the detective member 44 is soldered to the second printed circuit board 40. The inner insulator 10 is molded over the rear end of the mating member 20, the printed circuit board and the front end of the cable 120. The light transmissive member 50 is assembled to the inner insulator 10. The metal shell 70 is assembled to the light transmissive member 50 and the inner insulator 10 with resisting the mating section 47. The detector 42 controls the light source 41 to turn on or to turn off through the detective member 44 detecting a capacitance value on the metal shell 70.

Figure 9:
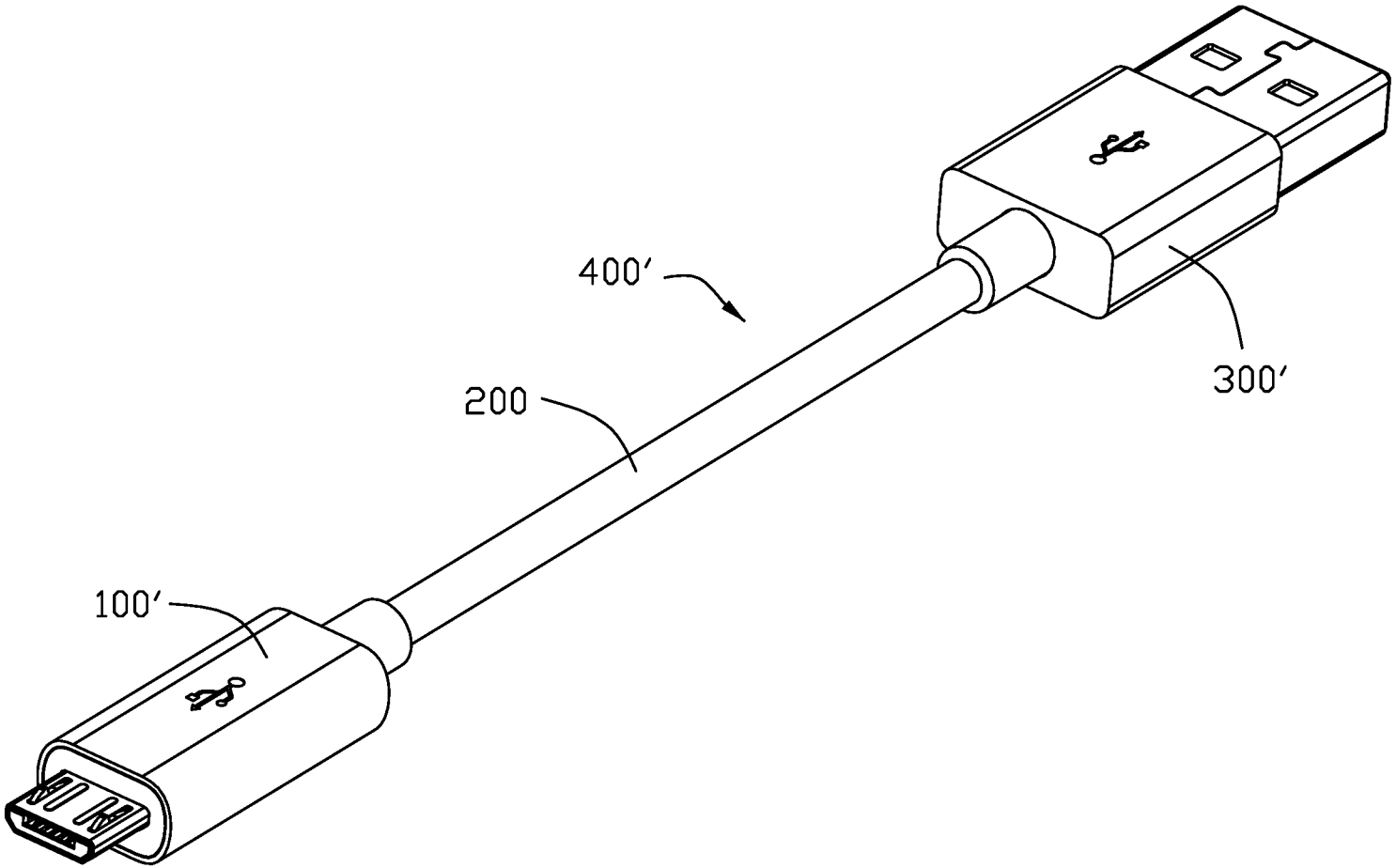
FIG. 9 is a perspective, assembled view of a cable connector assembly in accordance with a second embodiment of the present invention.
Figure 10:
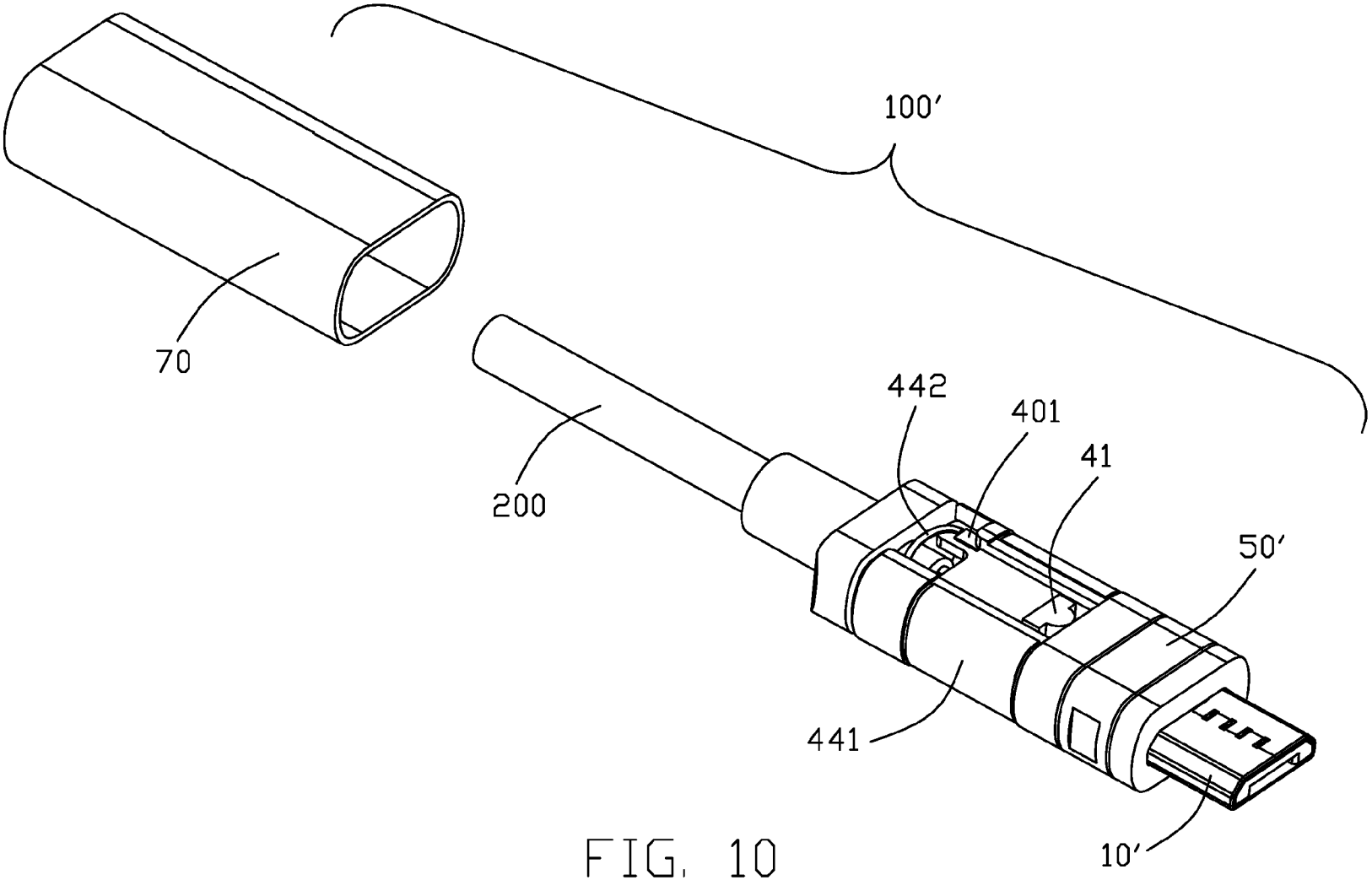
FIG. 10 is a perspective, partially exploded view of an electrical connector of the cable connector assembly shown in FIG. 9.
Figure 11:
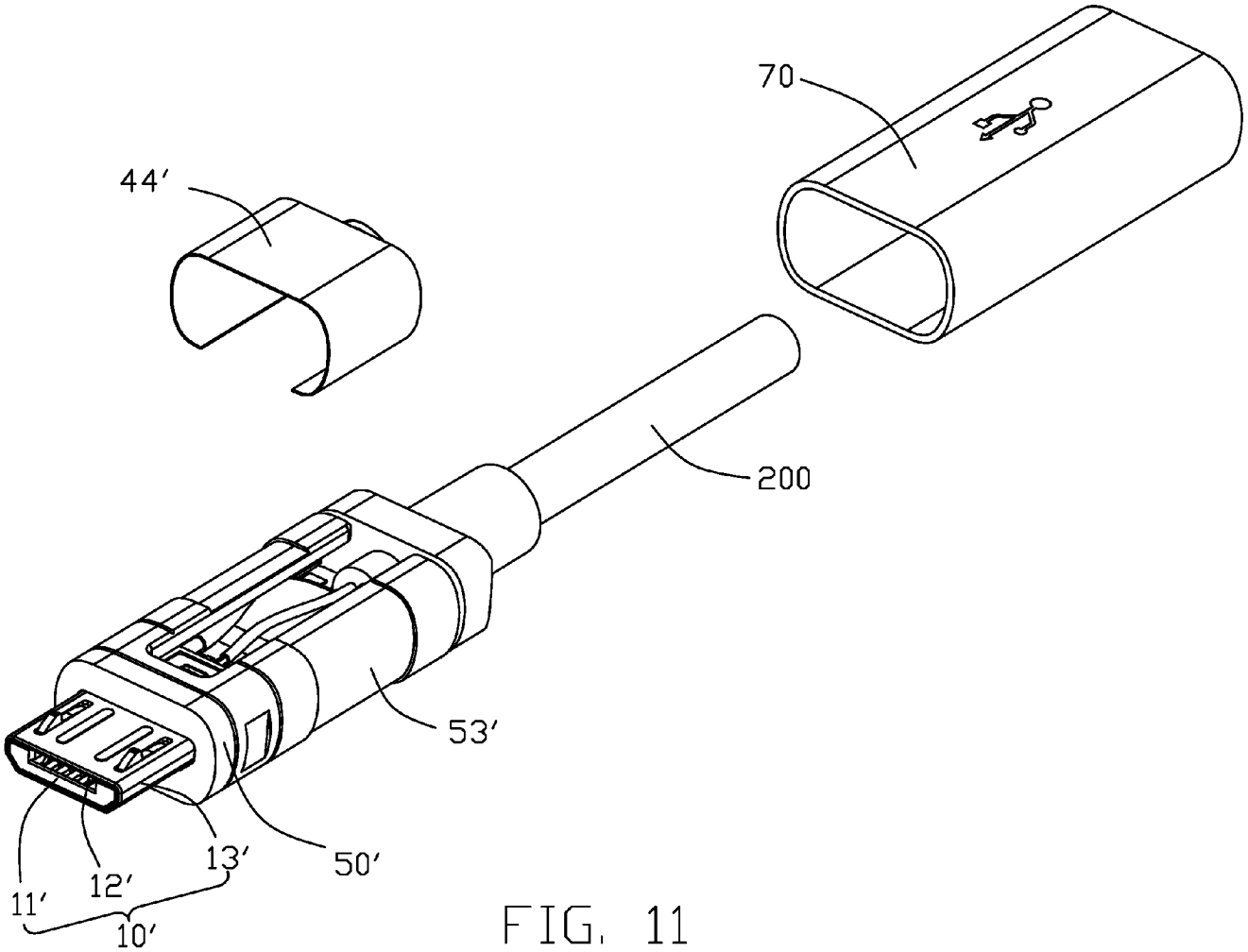
FIG. 11 is a further partially exploded view of the electrical connector shown in FIG. 10.
Figure 12:
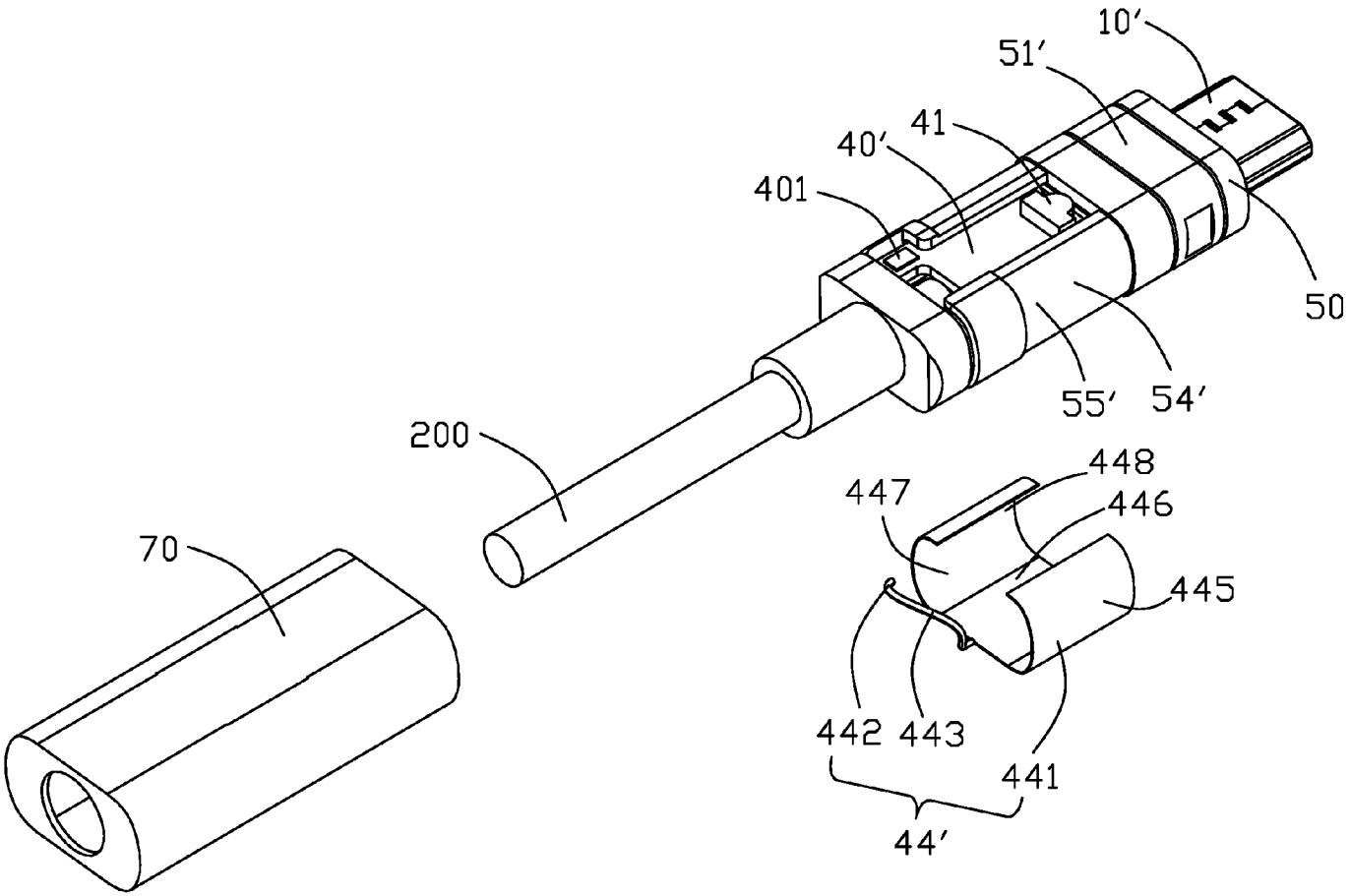
FIG. 12 is a view similar to FIG. 11, but viewed from another aspect.
Figure 13:
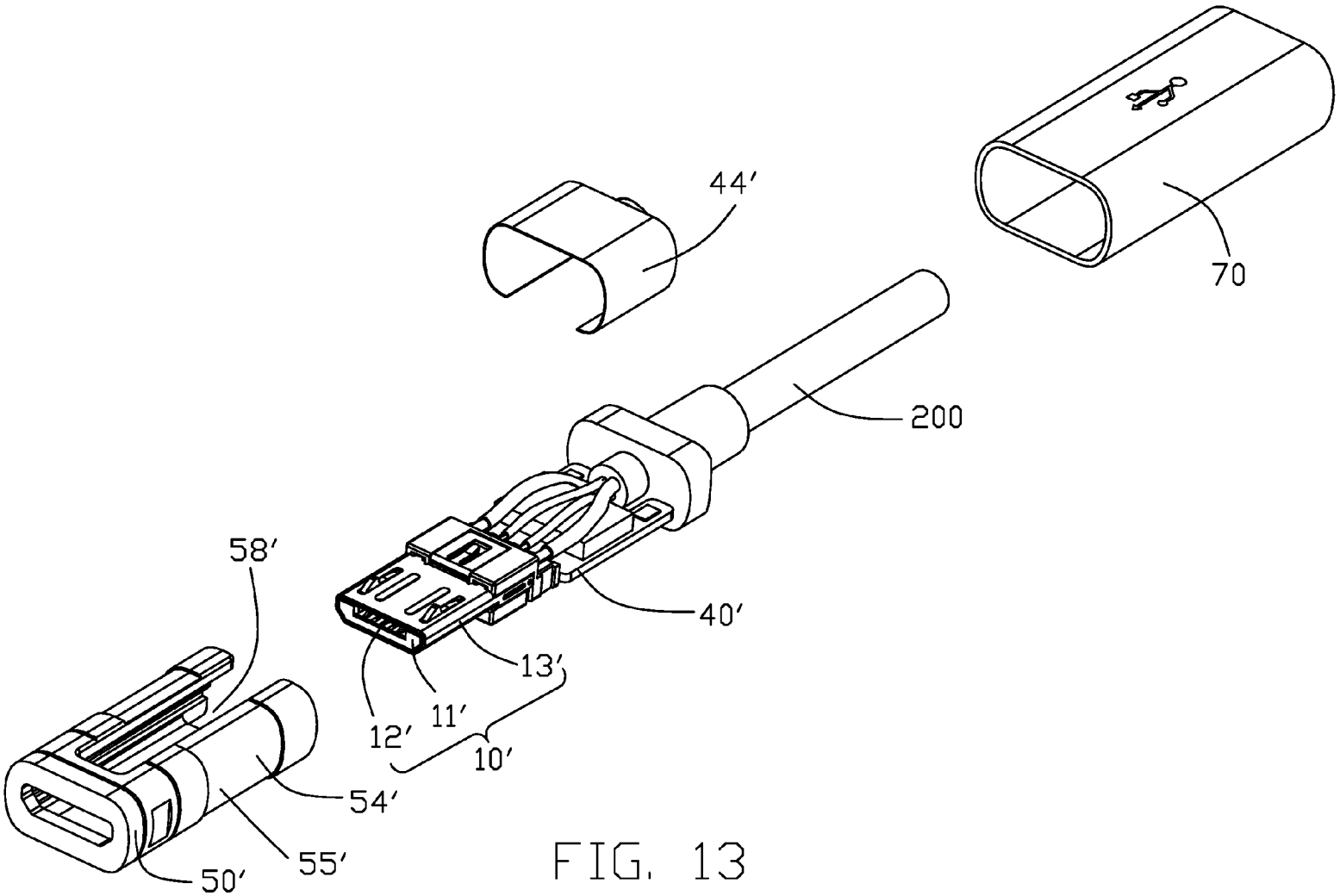
FIG. 13 is a further partially exploded view of the electrical connector shown in FIG. 11.
Figure 14:
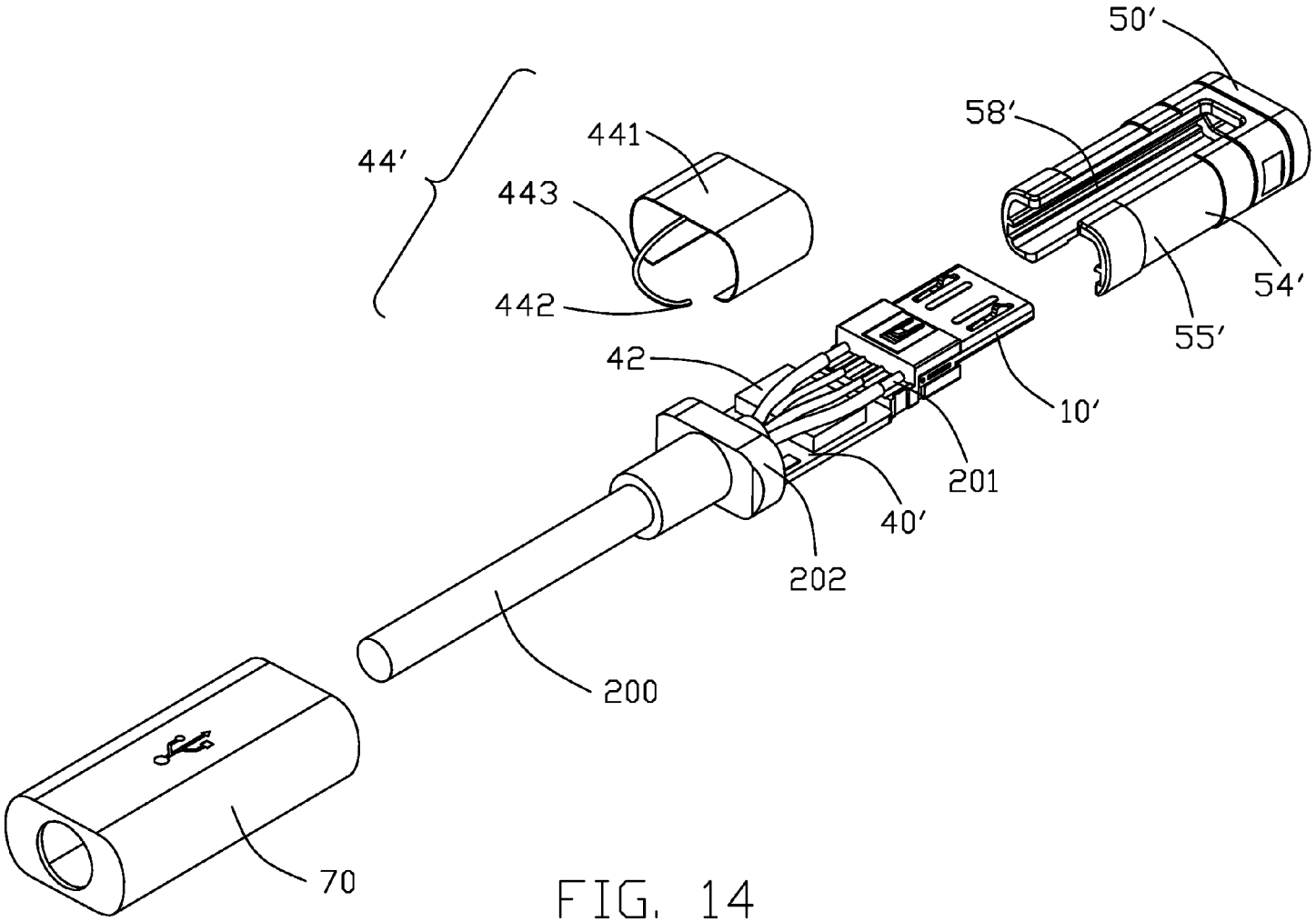
FIG. 14 is a view similar to FIG. 13, but viewed from another aspect.
Figure 15:
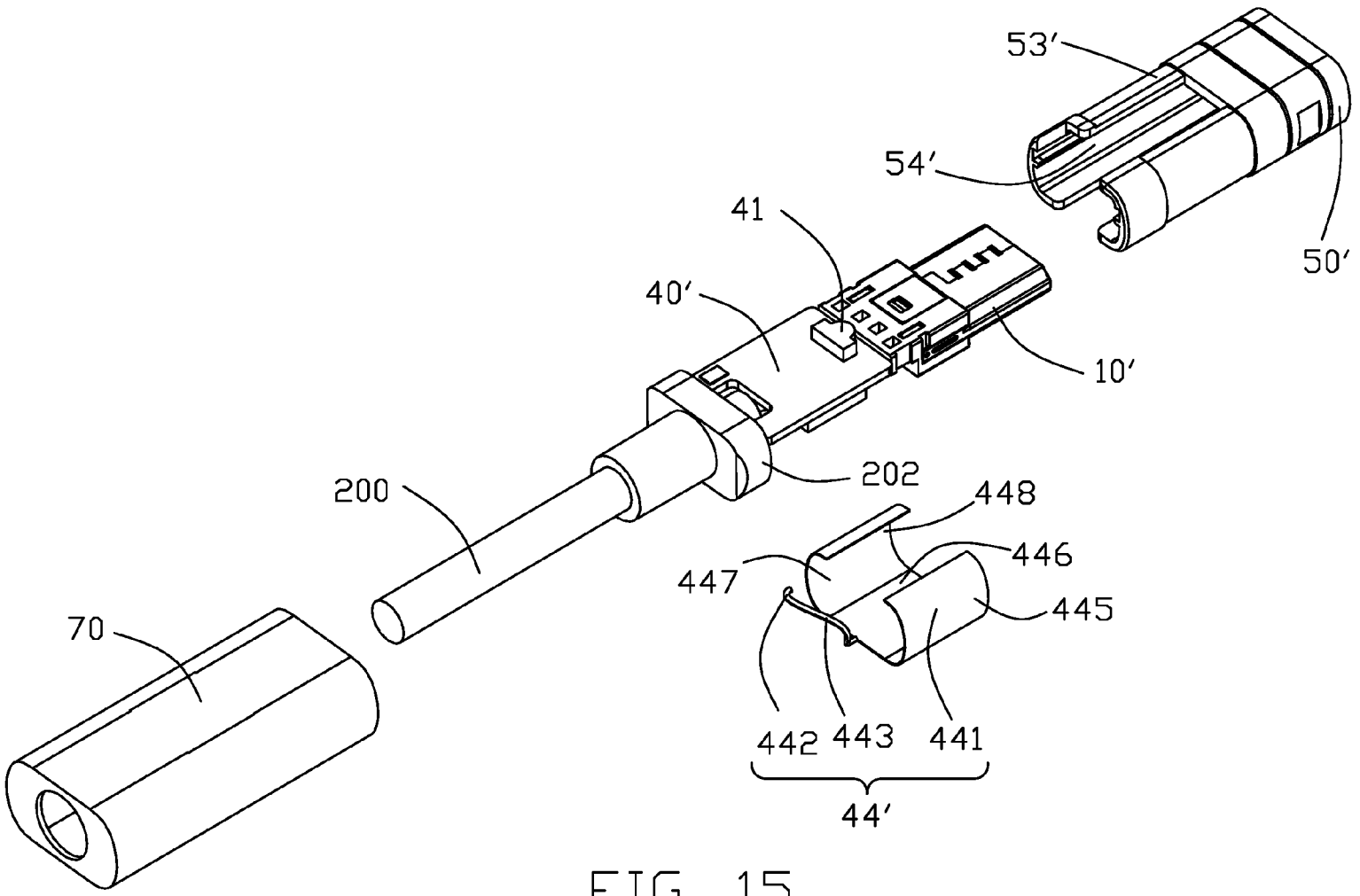
FIG. 15 is a similar to FIG. 14, but viewed from another aspect.

Referring to FIG. 9, the cable connector assembly 400' in accordance with a second embodiment of the present invention comprises an electrical connector 100', a USB connector 300' and a cable 200 connecting the electrical connector 100' and the USB connector 300'.

Referring to FIGS. 9-16, the electrical connector 100' comprises a mating member 10', a printed circuit board 40', a light source 41 and a detector 42 assembled on the printed circuit board, a light transmissive member 50' permitting transmission of a light emitted from the light source 41 therethrough, a detective member 44' associated with the detector 42, and a metal shell 70 enclosing the light transmissive member 50'.

Figure 16:
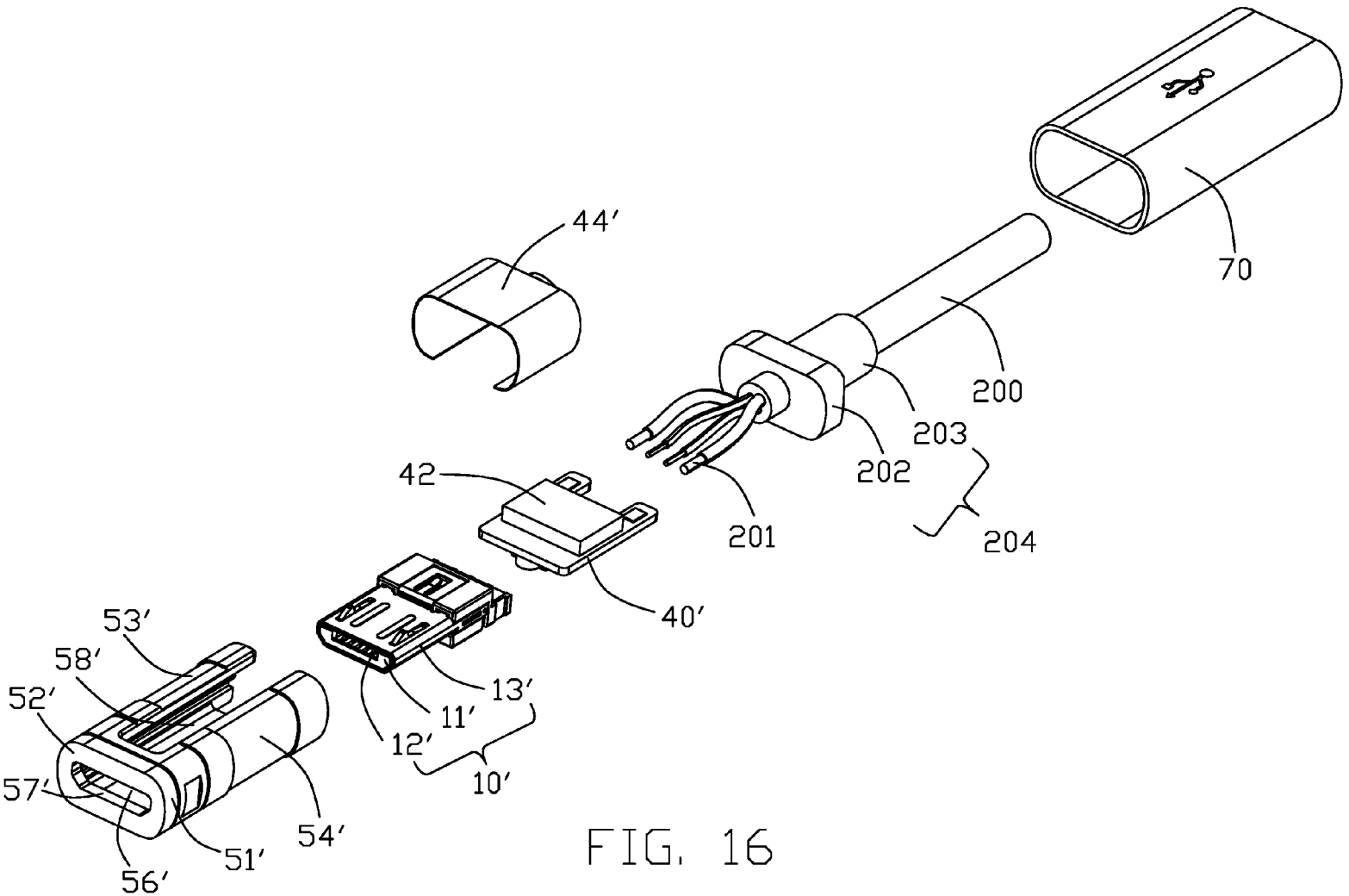
FIG. 16 is a perspective, exploded view of the electrical connector shown in FIG. 10.

The mating member 10' comprises an insulative housing 11', a plurality of contacts 12', and a shielding shell 13' enclosing the insulative housing 11', as shown in FIG. 16.

The detective member 44' comprises a fixed section 442 fasten on the printed circuit board 40', a mating section 441 resisting against the metal shell 70 and a connecting section 443 connecting the fixed section 442 and the mating section 441. The fixed section 442 is soldered to the printed circuit board 40' and connected with the detector 42 electrically. In the embodiment of the present invention, the fixed section 442 and the connecting section 443 are formed in a guide wire extending from the mating section 441. The mating section 441 is made of a copper foil, and comprises a pair of wrapping walls 445, a lower wall 446 connecting the two wrapping walls, a gap 448 corresponded with the lower wall 446, and a wrapping space 447 surrounded by the wrapping walls 445 and the lower wall 446. The thickness of the copper foil decreases gradually in a direction from the mating member 10' to the cable 200, so that the metal shell 70 can be assembled to the copper foil steadily with interfering with the lower wall 446.

The light transmissive member 50' comprises a penetrable portion 51' through which the light penetrates, a positioning portion 53' extending rearwardly from the penetrable portion 51' and a receiving space 56' surrounded by the penetrable portion 51' and the positioning portion 53'. The penetrable portion 51' comprises a penetrable section 52' located in a front end thereof and exposed out of a front end of the metal shell 70. The penetrable section 52' defines an opening 57' through which the mating member 10' passes. The opening 57' connects with the receiving space 56'. The positioning portion 53' comprises a pair of side walls 54', a settled section 55' and a pair of slots 58' between the side walls 54'. The slots 58 connect with the receiving space 56' so as to observe the condition of the mating member 10', the printed circuit board 40' and the cable 200. The settled section 55' is a recess sunken from a middle part of the side walls 54'. The mating section 441 is attached to the settled section 55' so as to be settled in the position portion 53'.

The cable 200 comprises a strain relief 204 and a plurality of wires 201. The strain relief 204 comprises a resisting section 202 and a holding section 203. The cable 200 is connected with the printed circuit board 40' and the contacts 12' electrically.

In assembly, the light source 41 and the detector 42 are positioned to the printed circuit board 40'. The printed circuit board 40' is located between the mating member 10' and the cable 200. The wires 201 are partially soldered to the contacts 12' of the mating member 10' and partially soldered to the printed circuit board 40'. The mating section 441 is assembled to the recess so as to keep a smooth connecting between the detective member 44' and the light transmissive member 50'. The fixed section 442 of the detective member 44' is soldered to a conducting strip 401 of the second printed circuit board 40' for connecting with the detector 42 electrically. The light transmissive member 50' is assembled to the mating member 10', the printed circuit board 40' and the front end of the cable 200. The metal shell 70 is assembled to the light transmissive member 50' with resisting the mating section 47. The detector 42 controls the light source 41 to turn on or to turn off through the detective member 44' detecting a capacitance value on the metal shell 70.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable-end electrical connector comprising:

a frontal mating member;

a printed circuit board connected with the mating member;

a light source positioned on the printed circuit board;

a detector for controlling the light source;

a light transmissive member permitting a light emitted from the light source to pass through;

a metal shell enclosing the light transmissive member and the printed circuit board; and a detective member connecting the detector and the metal shell electrically, wherein the metal shell encloses the printed circuit board and resists against the detective member; wherein the detective member comprises a copper foil assembled to the light transmissive member and resisting against the metal shell and a guide wire connecting with the copper foil electrically; wherein the copper foil comprises a pair of wrapping walls, a lower wall, and a wrapping space surrounded by the wrapping walls and the lower wall, and the thickness of the copper foil increases gradually in a direction toward the mating member; wherein the detective member comprises a fixed section fastened on the printed circuit board, a mating section resisting against the metal shell, and a connecting section connecting the fixed section and the mating section, wherein the detective member further comprises a gradient section extending downwardly from the mating section for enhancing a strength of the mating section, and the connecting section is elastic for resisting against the metal shell closely; wherein the mating section is parallel to the fixed section, and the gradient section and the connecting section are symmetrical approximately; wherein the light transmissive member comprises a penetrable portion and a positioning portion extending rearwardly from the penetrable portion, the light penetrates through the penetrable portion, and the penetrable portion comprises a penetrable section located in a front end thereof and exposed out of a front end of the metal shell; wherein the penetrable section defines an opening through which the mating member passes.

2. The electrical connector as claimed in claim 1, wherein the detector controls the light source through the detective member detecting a capacitance value on the metal shell.

3. The electrical connector as claimed in claim 1, wherein the positioning portion comprises a pair of side walls, a settled section and a slot between the two side walls.

4. The electrical connector as claimed in claim 3, wherein the settled section is a recess sunken from a middle part of side walls, and the detective member is assembled to the recess so as to keep a smooth connecting between the detective member and the light transmissive member.

5. The electrical connector as claimed in claim 3, wherein the settled section extends upwardly from the side walls, and the printed circuit board defines a trough coordinated with the settled section and located in two sides thereof.

6. The electrical connector as claimed in claim 3, wherein the printed circuit board comprises a first printed circuit board and a second printed circuit board, and the first printed circuit board and the second printed circuit board are connected with each other electrically through a plurality of connecting contacts.

7. A cable-end electrical connector comprising:

a frontal mating member;

a printed circuit board connected with the mating member, wherein the metal shell encloses the printed circuit board and resists against the detective member; wherein the detective member comprises a copper foil assembled to the light transmissive member and resisting against the metal shell and a guide wire connecting with the copper foil electrically; wherein the copper foil comprises a pair of wrapping walls, a lower wall, and a wrapping space surrounded by the wrapping walls and the lower wall, and the thickness of the copper foil increases gradually in a direction toward the mating member; wherein the detective member comprise a copper foil assembled to the light transmissive member and a guide wire connecting with the copper foil electrically, and the thickness of the copper foil increases gradually in a direction toward the mating member; wherein the detective member comprises a fixed section fasten on the printed circuit board, a mating section resisting against the metal shell, and a connecting section connecting the fixed section and the mating section;

a light source and a detector connected with the printed circuit board electrically;

a light transmissive member permitting transmission of a light emitted from the light source therethrough;

a detective member connected with the printed circuit board electrically; and a shell enclosing the light transmissive member with resisting against the detective member; wherein the detector controls the light source through the detective member detecting a capacitance value on the metal shell.

* * * * *